United States Patent [19]

Sherman et al.

[11] Patent Number: 4,923,622

[45] Date of Patent: May 8, 1990

[54] FABRIC SOFTENER COMPOSITION: CONCENTRATE OF QUATERNARY AMMONIUM COMPOUND AND AN OIL

[75] Inventors: Rudolf W. Sherman, Knutsford; Philip J. Stainer, Dennis, both of England

[73] Assignee: Imperial Chemical Industries PLC, London, England

[21] Appl. No.: 245,806

[22] Filed: Sep. 19, 1988

Related U.S. Application Data

[63] Continuation of Ser. No. 808,374, Dec. 16, 1985, Pat. No. 4,792,409, which is a continuation of Ser. No. 258,994, Apr. 30, 1981, abandoned, which is a continuation of Ser. No. 952,649, Oct. 19, 1978, abandoned.

[30] Foreign Application Priority Data

Oct. 22, 1977 [GB] United Kingdom ..... 44062/77

[51] Int. Cl.[5] ..... C11D 1/62; D06M 13/46; D06M 15/18

[52] U.S. Cl. ..... 252/8.6; 8/115.6; 252/8.8

[58] Field of Search ..... 252/8.6; 8/115.6

[56] References Cited

U.S. PATENT DOCUMENTS

| | | | |
|---|---|---|---|
| 3,793,196 | 2/1974 | Okazaki | 252/8.8 |
| 3,861,870 | 1/1975 | Edwards | 8/115.6 |
| 4,128,484 | 12/1978 | Barford | 252/8.6 |
| 4,464,273 | 8/1984 | Parslow et al. | 252/8.8 |
| 4,792,409 | 12/1988 | Sherman et al. | 252/8.6 |

FOREIGN PATENT DOCUMENTS

| | | |
|---|---|---|
| 842842 | 7/1960 | United Kingdom . |
| 1379015 | 1/1975 | United Kingdom . |

*Primary Examiner*—A. Lionel Clingman

*Attorney, Agent, or Firm*—Cushman, Darby & Cushman

[57] ABSTRACT

A fabric softener concentrate consists of a quaternary ammonium salt containing at least one $C_8$ to $C_{30}$ long chain alkyl group, for example dimethyl distearyl ammonium chloride, and an oil or substantially water-insoluble compound having oily/fatty properties, for example a half refined white oil or an alkyl ester of a long chain fatty acid. The liquid concentrate can be dispersed/emulsified in cold water to form a fabric softener composition.

2 Claims, No Drawings

FABRIC SOFTENER COMPOSITION: CONCENTRATE OF QUATERNARY AMMONIUM COMPOUND AND AN OIL

This is a continuation of application Ser. No. 06/808,374, filed Dec. 16, 1985, now U.S. Pat. No. 4,792,409 which is a continuation of Ser. No. 258,994, filed Apr. 30, 1981, which is a continuation of 952,649, filed Oct. 19, 1978 both abandoned.

The present invention relates to fabric softeners.

Traditional fabric softeners are based on quaternary ammonium salts such as dimethyl distearyl ammonium chloride or an alkyl imidazolinium salt, and generally comprise not less than 5% of this active ingredient. It is necessary to use such an amount of quaternary ammonium salt in order that a fabric softener may be obtained having a commercially acceptable viscosity. Fabric softeners are usually somewhat viscous since without sufficient viscosity the quaternary ammonium salt may tend to separate from the composition.

These quaternary ammonium salts are normally supplied by the manufacturers in the form of a paste or slurry containing 75% of the quaternary salt, 15–25% of a liquid such as isopropyl alcohol and a balance, if any, of water, and the paste must be dispersed/emulsified in warm to hot water, mixed with coventional additions such as perfumes, optical brightener, dye etc. in order to obtain a complete fabric softener and then cooled again. The dispersion/emulsification operation must be conducted carefully since the shear of the stirrer as well as the temperature will influence the viscosity of the fabric softener and, since it is very difficult to thicken the product once the dispersion/emulsification is complete, it is necessary that the dispersion/emulsification operation is carefully controlled to ensure that the correct viscosity is obtained. For these reasons it is not always possible for wholesale or retail suppliers of fabric softeners to make up their own fabric softener for sale.

We have now surprisingly found that a fabric softener liquid concentrate can be prepared which may be readily and easily dispersed/emulsified in cold water to produce a fabric softener with an acceptable commercial viscosity.

According to the present invention there is provided a fabric softener concentrate comprising a fatty quaternary ammonium salt and an oil or substantially water-insoluble compound having oily/fatty properties.

The present invention further comprises a fabric softener composition comprising water, a fatty quaternary ammonium salt and an oil or compound having oily/-fatty properties.

By a fatty quaternary ammonium salt we mean that the quaternary ammonium salt contains at least one long chain alkyl group of 8 to 30 carbon atoms, preferably 8 to 22 carbon atoms, and, optionally, at least one lower alkyl or substituted lower alkyl group, for example a methyl, ethyl or 2-hydroxyethyl group. In this respect any one or more of the quaternary ammonium salts conventionally used in fabric softeners may be used in the invention and the preferred quaternary ammonium salt is dimethyl distearyl ammonium chloride. Although this is an example of a quaternary salt having four alkyl groups bonded to the nitrogen atom it is to be understood that the term quaternary ammonium salt as used herein extends also to compounds in which the nitrogen atom is part of a heterocyclic ring, such as imidazoline salts. Other suitable quaternary ammonium salts include those prepared by the reaction of a suitable quaternising agent, for example methyl chloride, with a mixture of amines known as ∓Synprolam" D35 (Registered Trade Mark). "Synprolam" D35 comprises 65 to 75% $C_{13}$ and approximately 35 to 25% $C_{15}$ amines with approximately 50 wt% straight chain and 50 wt% branched chain amines where the branching is predominantly 2-methyl.

The oil or compound having oily/fatty properties may be selected from a very wide variety of oils or such compounds. The compound or oil may have lubricant properties with regard to the fabrics to be treated. Particularly suitable are mineral oils, for example half refined white oil available from Texaco under the description Base Oil 522 or from Gulf oil under the description Gulf Par 940. Other oils which are suitable include those containing compounds having from 8 to 22 carbon atoms, for example soya oil, rape seed oil, coconut oil, sunflower oil.

Examples of compounds having oily/fatty properties which may be used in accordance with the invention are the alkyl esters of long chain fatty acids, for example methyl oleate, butyl stearate, butyl palmitate, glyceryl monostearate and glyceryl mono-oleate, and long chain fatty alcohols. We have found some evidence which indicates that the particular oily/fatty compound used can beneficially affect the feel of the fabric treated with the fabric softener.

The quaternary ammonium salt and the oil (or compound having oil/fatty properties) may be used in a wide variety of proportions in both the fabric softener concentrate and fabric softener composition of the invention. In some cases, the quaternary ammonium salt may be the major component. However, where it is desired to make a cheaper product it is preferred that the lubricant (or oily/fatty compound) which is the cheaper component should be present in a major amount since it may also have fabric softening properties and may be used as a substitute for the comparatively expensive quaternary salt. A typical fabric softener composition according to the invention will be of 3 to 20%, more preferably 5 to 10% active, strength (oil (or oily/fatty compound) plus quaternary salt) and such a softener composition is obviously cheaper to produce than one having the same active strength of the quaternary ammonium salt alone.

It is preferred that the fabric softener concentrate should include a lower aliphatic alcohol containing up to 6 carbon atoms, for example, methanol ethanol or isopropyl alcohol as an additive which gives the required viscosity properties and low temperature stability. The Applicants have found that in some cases it is of advantage to the fabric softener concentrate or composition to include a surfactant (preferably non-ionic or cationic) which may assist in stabilising the concentrate or composition. Examples of suitable surfactants for use in the invention include alcohol ethoxylates, amine ethoxylates and their salts, alkyl phenol and dialkyl phenol ethoxylates.

The fabric softener concentrate of the invention may be readily and easily dispersed/emulsified in cold water, typically mains water, at a temperature suitably within the range 5° to 30° C., more suitably 5° to 20° C., without the need for heating and with only light mixing to produce a fabric softener composition of the required active strength, which will generally be in the range 3 to 20%. Alternatively the fabric softener composition may be produced simply by producing a dispersion- /emulsion in water of a quaternary ammonium salt and an oil (or oily/fatty compound), the latter two components not having been previously admixed to produce a concentrate. The Applicants have found that in some cases it is desirable to use a solvent, for example isopropyl alcohol, to assist the preparation of the composition at the preferred relatively low temperature used.

The viscosities of the fabric softener concentrate and composition depend on both the type and the amount of oil or oily/fatty compound incorporated therein and it is an easy matter to produce fabric softeners having a range of viscosities by varying the time and amount of oil or oily/fatty compound used. It is also found that the amount of quaternary salt required to produce a dispersion/emulsion of a particular viscosity is less than in the case where no oil (or compound having oily/fatty properties) is used and these features are important advantages of the present invention. The Applicants consider that acceptable commercial viscosities are likely to lie in the range of 15 to 40 seconds, more suitably in the range 20 to 25 seconds, measured at 20° C. in No 4 Ford Cup.

Fabric softener concentrate and compositions according to the invention can be produced without the need for the very careful control of the mixing operation which is a feature of prior art preparations. The invention thus makes it possible for fabric softeners to be produced by manufacturers who, because of their lack of suitable mixing equipment, were previously required to purchase softener because of the difficulties in its manufacture. Conventional additions such as dyes and optical brighteners may of course be added during the production of the fabric softener as desired.

The following Examples illustrate the concentrate and composition of the present invention.

EXAMPLE 1

Two fabric softener concentrates were prepared by mixing the various constituents in amounts as shown in Table 1 (all parts are by weight):

TABLE 1

| Constituent | Concentrate A: | Concentrate B: |
|---|---|---|
| Kemamine Q 9702 C | 4 parts | 4 parts |
| Texaco Base Oil 522 | 6 parts | 5 parts |
| Methanol | 1 part | 2 parts |
| Isopropyl alcohol | — | 1 part |
| Non-ionic surfactant | 1 part | 1 part |

Kemamine Q 9702 C is a commercially available quaternary ammonium product which is based on 75% dimethyldihydrogenated tallow ammonium chloride.

The non-ionic surfactant used was "Synperonic" A3 (Registered Trade Mark) which is a commercially available mixture of detergent alcohol ethoxylates prepared from a carefully controlled mixture of $C_{13}$ and $C_{15}$ alcohols.

The two concentrates, which were thin mobile liquids at room temperature, were dispersed/emulsified in cold water without heating to produce fabric softener compositions of commercially acceptable viscosity and performance.

EXAMPLE 2

Two fabric softener compositions were prepared by mixing the various constituents in amounts as shown in Table 2:

TABLE 2

| Constituent | Composition L | Composition M |
|---|---|---|
| Kemamine Q 9702 C | 1 oz | 1 oz |
| Texaco Base Oil 522 | 2 oz | 1½ oz |
| Optical brightener (0.2% solution) | 10 oz | 5 oz |
| Blue dye (0.2 solution) | 2¼ oz | 2¼ oz |
| Perfume | 0.95 cc | 0.94 cc |
| Water | 18 oz | 23 oz |

The non-ionic surfactant used was "Synperonic" A2 (Registered Trade Mark) which is of similar composition to "Synperonic" A3 (See Example 1).

Compositions L and M had active strengths of 6¾% and 5–7% respectively and each was found to be of commercially acceptable viscosity and performance.

EXAMPLE 3

Arquad 2HT (a dihydrogenated tallow dimethylammonium chloride) and Texaco Base Oil 522 were mixed together in various ratios. To 10 g of each mixture isopropanol was added until a liquid product resulted at 23° C. Similarly isopropanol was added to blends of 1 g of non-ionic surfactant ("Synperonic" A3) and 9 g Arquad 2HT/Texaco Base Oil 522 mixture to form a liquid product. Table 3 shows the weights of isopropanol required:

TABLE 3

| OIL:ARQUAD 2HT RATIO | 5:1 | 10:3 | 5:2 | 2:1 | 5:3 | 10:7 | 10:9 |
|---|---|---|---|---|---|---|---|
| Isopropanol required (g) | | | | | | | |
| Without surfactant | 2.75 | 3.77 | 2.83 | 3.70 | 2.90 | 4.23 | 5.61 |
| With surfactant | 1.30 | 1.15 | 1.73 | 1.10 | 6.77 | 6.78 | 5.30 |

NOTE: When isopropanol was added to 10 g Arquad 2HT alone, substantial amounts of solid remained even after addition of 15 g isopropanol. After 40 g isopropanol had been added, the product was substantially liquid although small amounts of solid settled in time. Clearly, the use of an oil reduces considerably the amount of solvent required to produce a stable liquid product.

EXAMPLE 4

Mixtures of Arquad 2HT with two oil/fatty materials were made. Isopropanol was added to 10 g of each mixture or 9 g of mixture and 1 g non-ionic surfactant ("Synperonic" A3) as in Example 3. Table 4 shows the weights of isopropanol required:

TABLE 4

| OIL | "SYNPROL" Primary alcohol | | ISOBUTYL PALMITATE | | |
|---|---|---|---|---|---|
| Oil:Arquad 2HT Ratio | 5:1 | 10:9 | 9:1 | 1:1 | 1:9 |
| Isopropanol required | | | | | |
| Without surfactant | 7.25 | 8.62 | 3.4 | 7.3 | 8.2 |
| With surfactant | 7.30 | 11.30 | 3.1 | 6.1 | 7.5 |

"Synprol" (Registered Trade Mark) is a high quality primary alcohol and is a carefully controlled mixture of 67% $C_{13}$ and 33% $C_{15}$ alcohols.

EXAMPLE 5

A fabric softener concentrate was prepared by mixing "Synprolam" D35QC (Registered Trade Mark), which is a mixture of quaternary compounds derived from "Synprolam" D35 and comprises approximately 75% di ($C_{13}$–$C_{15}$) dimethyl ammonium chloride and approximately 25% isopropanol, with (a) Texaco 522 oil, (b) "Synprol", (c) Tung oil, (d) Isobutyl palmitate, each in ratios of 9:1 and 1:9 by weight. All mixtures were liquid at 23° C.

EXAMPLE 6

Varisoft 475 (1-tallowalkyl amidoethyl 2-tallowalkyl-3-methyl imidazolinium methosulphate) was mixed with (a) Texaco 522 oil, (b) "Synprol", (c) Tung oil in ratios of 9:1 and 1:9 by weight. All mixtures were liquid at 23° C.

EXAMPLE 7

A fabric softener concentrate was prepared by mixing Kemamine QSML/2 (4 pts) and non-ionic surfactant "Synperonic" A3 (1 pt) with coconut oil (6 pts) at 23° C. A clear mobile liquid was obtained.

NOTE: Kemamine QSML/2 is a quaternary ammonium product which is based on approximately 70% dimethyldihydrogenated tallow ammonium chloride and approximately 30% methanol.

EXAMPLE 8

A mixture of 4 pts "Synprolam" and 6 pts "Synprol" was diluted in water to give a dispersion containing 2.33% quaternary salt wt/wt. This had a viscosity at 25° C. of ca 290 cS. A dispersion in water containing 2.33% quaternary salt and no "Synprol" had viscosity ca 2 cS. The dispersion with "Synprol" was stable showing no separation after seven days.

EXAMPLE 9

A mixture of 4 pts Kemanine QSML/2 and 6 pts Texaco 522 oil was diluted in water to give a dispersion containing 2.33% quaternary salt wt/wt. This had a viscosity at 25° C. of 783 cS. A dispersion containing 2.33% quaternary salt and no oil had viscosity 59 cS. The dispersion with oil was stable showing no separation after seven days.

EXAMPLE 10

A fabric softener concentrate was prepared by mixing 4.225 parts Gulf Par 940, 3.028 parts Kemamine QSML/2 and 0.634 parts "Synperonic" A3 (Registered Trade Mark) surfactant. A fabric softener composition was prepared by dispersing the concentrate in water to form a composition containing 7.887% concentrate.

Two such compositions were prepared, the concentrate temperature in each case being 25° C. The temperature of the water used was 25° C. in one case and 30° C. in the other and the viscosities (at 20° C. using No 4 Ford Cup) were respectively 25 seconds and 12 seconds.

It is clear, therefore, that it is advantageous to prepare fabric softener compositions according to the invention by cold mixing of the concentrate and water. In this way, it is possible to obtain compositions of commercially acceptable viscosity. Mixing at higher temperatures produces less viscous, unacceptable compositions.

EXAMPLE 11

A liquid fabric softener concentrate was prepared by mixing 50 wt% of Alkaquat T (a 75% active 1-methyl tallowamidoethyl 2-tallow imidazolinium methosulphate), 40 wt% Texaco Base Oil 522 and 10 wt% "Synperonic" A3 (Registered Trade Mark) surfactant.

EXAMPLE 12

A liquid fabric softener concentrate was prepared by mixing 10 wt% of Actisoft TE (a 1-tallowalkyl amidoethyl 2-tallowalkyl-3-methyl imidazolinium methosulphate), 27.25% Kemamine QSML/2, 38.02 wt% Gulf Par Oil 940, 5.71% "Synperonic" A3 (Registered Trade Mark) Surfactant, and 19.02% isopropyl alcohol. The concentrate was a clear mobile liquid at temperatures down to 5° C.

The viscosity of a 7% dispersion/emulsion in water at 20° C. was compared with that of a 7% dispersion-/emulsion of a concentrate containing no Actisoft TE and consisting of 30.28% Kemamine QSML/2, 42.25% Gulf Par Oil 940, 6.34% "Synperonic" A3 surfactant and 21.13% isopropanol. The viscosities (at 20° C. using No 4 Ford Cup) were respectively 16 seconds and 11 seconds, thus indicating that the composition containing both Actisoft TE and Kemamine QSML/2 had a rather more commercially acceptable viscosity than that containing Kemamine QSML/2 alone.

EXAMPLE 13

A series of tests were carried out on a number of fabric softening compositions to assess the softness of fabrics treated with them.

The fabrics used in the tests were babies nappies which were 50% cotton and 50% viscose. After desizing by washing with a commercial washing powder ("Drive") and rinsing throughout, the nappies were put through four wash-rinse-treat cycles as follows:

Wash cycle: tap water at 50° C. containing 1 g commercial washing powder ("Tide") per liter at a fabric: water ratio of 1 kg: 30 l over 5 min.

Rinse cycle: Four washes in tap water at 25° C. at a fabric: water ratio of 1 kg: 30 l.

Treatment: Formulated fabric softener product was applied at the rate of 10 g per 300 g fabric in 9 l tap water at 25° C. over 2 min.

Drying: All nappies were dried separately in a tumble dryer.

Two fabric softener formulations according to this invention were used with water being used as a control. The formulations were:

1. Kemamine QSML/2, 2.2% active wt/wt+Texaco Base Oil 522 6.67% wt/wt in water
2. Kemamine QSML/2, 2.2% active wt/wt+Coconut Oil 6.67% wt/wt in water
3. Water only After 1 cycle and 4 cycles 24 judge paired comparison panel tests were carried out to evaluate softness. The results of these tests are shown in Table 5:

TABLE 5

| Panel Test for Softness : Votes awarded to each treatment (½ vote awarded where no decision) | | |
|---|---|---|
| Formulation No. | 1 cycle | 4 cycles |
| 1 | 30.5 | 39 |
| 2 | 30.5 | 33 |
| 3 | 11 | 0 |

NOTE: For a 3 object paired comparison test with 24 judges a difference of votes is significant at the 95% level.

These tests indicate the excellent qualities possessed by formulations 1 and 2 which, coupled with their ease of manufacture, give them advantages over other similar formulations prepared in the past without the use of an oil or oily/fatty compound. Besides the good softening properties shown, the results suggest that different oils may give different degrees of fabric softening.

EXAMPLE 14

Wetting tests were carried out by a modified Draves test comparing a 10% dilution of a fabric softener composition according to this invention to a proprietary brand containing 5% active dimethyl di-hydrogenated tallow ammonium chloride (DMDHT). (The fabric softener composition according to this invention consisted of (all parts by wt) 30.28% Kemamine QSML/2, 42.25% Gulf Par Oil 940, 6.34% "Synperonic" A3 surfactant, and 21.13% isopropanol.)

Cotton tapes of one inch width and 20 cm length were soaked and dried five times in the two products using 3 pieces of tape in 250 cc solution containing 1% of the fabric conditioner. The experiment was repeated by soaking and drying once only in a 5% solution of conditioners. The wetting test was carried out using a 20 gm weight attached by means of a cotton thread to a metal hook weighing approx. ½ gm. The hook is attached to the treated cotton pieces and dropped into a 500 cc measuring cylinder full of water. The time is measured for the hook attached to the fabric to sink to the bottom.

The times were as follows:

One immersion at 5% conditioner concentration
10% composition of the invention: 20 seconds
5% active DMDHT: 33 seconds Five immersions at 1% concentration
10% composition of the invention: 21 seconds
5% active DMDHT: 63 seconds The water temperature was 12° C.

It would appear that fabric conditioners according to this invention are superior in re-wetting and that there is virtually no build up of product on the cotton pieces.

We claim:

1. A substantially water-free softener liquid concentrate consisting essentially of a non-heterocyclic fatty quaternary ammonium salt which contains at least one long chain alkyl group of 8 to 30 carbon atoms and an oil or water-insoluble compound having oily/fatty properties and selected from the group consisting of a mineral oil, a half-refined white oil, rape seed oil, sunflower oil, tung oil and long chain $C_8$ to $C_{24}$ fatty alcohols, said concentrate having a viscosity in the range of about 15 to 40 seconds, measured at 20° C. in No. 4 Ford Cup, and said concentrate capable of being dispersed-/emulsified in cold water at a temperature of 5° to 30° C.

2. A concentrate as in claim 1 wherein the quaternary ammonium salt is a tetraalkyl ammonium salt.

* * * * *